US005562506A

United States Patent [19]

Wright

[11] Patent Number: 5,562,506

[45] Date of Patent: Oct. 8, 1996

[54] RADIO CONNECTOR

[75] Inventor: John O. Wright, York, Pa.

[73] Assignee: Osram Sylvania Inc., Danvers, Mass.

[21] Appl. No.: 462,494

[22] Filed: Jun. 5, 1995

[51] Int. Cl.[6] ..... H01R 17/04

[52] U.S. Cl. ..... 439/675; 439/578; 439/825

[58] Field of Search ..... 439/607, 675, 439/668, 578, 585, 825, 540.1, 847, 290, 291, 349; D13/133

[56] References Cited

U.S. PATENT DOCUMENTS

| | | | |
|---|---|---|---|
| D. 337,990 | 8/1993 | Wright | D13/133 |
| 4,666,232 | 5/1987 | Shyu | 439/578 |
| 5,021,001 | 6/1991 | Ramirez | 439/349 |
| 5,061,207 | 10/1991 | Wright | 439/578 |
| 5,137,477 | 8/1992 | Wright | 439/825 |
| 5,269,711 | 12/1993 | Wright | 439/825 |
| 5,456,611 | 10/1995 | Henry et al. | 439/578 |
| 5,474,478 | 12/1995 | Ballog | 439/578 |
| 5,486,123 | 1/1996 | Miyazaki | 439/825 |
| 5,522,735 | 6/1996 | Wright | 439/540.1 |
| 5,536,184 | 7/1996 | Wright | 439/578 |

*Primary Examiner*—David Pirlot
*Assistant Examiner*—Brian J. Biggi
*Attorney, Agent, or Firm*—W. H. McNeill

[57] ABSTRACT

An electrical connector is provided which includes a first connector housed within an assembly which includes an inner insulator and an outer metal shell, and a second connector. The insulator and the outer metal shell include a plurality of protuberances which engage a plurality of respective openings and abutment surfaces of the second connector to prevent rotational and axial movement of the first connector relative to the second connector.

16 Claims, 4 Drawing Sheets

RADIO CONNECTOR

BACKGROUND OF THE INVENTION

1. Field of the Invention

The present invention relates to a connector such as, for example, an antenna connector. More particularly, the present invention relates to an antenna connector for use with an automobile radio.

2. Description of the Prior Art

A typical antenna connector for an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such prior an devices inadvertent axial and/or rotational movement of the male connector body relative to the female connector body makes providing a satisfactory electrical connection difficult. In addition, the lack of satisfactory tactile feedback makes it difficult to know when a suitable connection has been made.

It is an object of the present invention to provide a connector wherein a male connector body does not inadvertently move in a rotational and/or an axial direction relative to a female connector body.

It is another object of the present invention to provide such a connector which provides tactile feedback during assembly.

SUMMARY OF THE INVENTION

This invention achieves these and other objects by providing a connector comprising an insulator comprising a first cylindrical member having a longitudinal axis, a first end and an opposite second end, the opposite second end comprising a base portion having an aperture extending therethrough in the direction of the longitudinal axis. The cylindrical member comprises a plurality of first legs which extend in the direction of the longitudinal axis from the first end towards the base portion. At least one first leg of the plurality of first legs comprises a first protuberance which protrudes towards the longitudinal axis. Each first leg of the plurality of first legs is spaced from an adjacent first leg in a circumferential direction relative to the longitudinal axis to provide a respective first opening between adjacent legs.

A metal shell comprising a second cylindrical member is concentric with and external of the first cylindrical member and extends in the direction of the longitudinal axis from one end to another end. The one end comprises a plurality of second legs which extend in the direction of the longitudinal axis from the one end towards a first edge of the second cylindrical member located between the one end and the other end. Each second leg of the plurality of second legs is spaced from an adjacent second leg in a circumferential direction relative to the longitudinal axis. At least one of the second legs of the plurality of second legs comprises a second protuberance which extends through a first opening in the first cylindrical member towards the longitudinal axis.

A first metal connector is provided which extends through the aperture in the first cylindrical member in the direction of the longitudinal axis.

BRIEF DESCRIPTION OF THE DRAWINGS

This invention may be clearly understood by reference to the attached drawings in which.

DESCRIPTION OF THE PREFERRED EMBODIMENT

Figure 1:
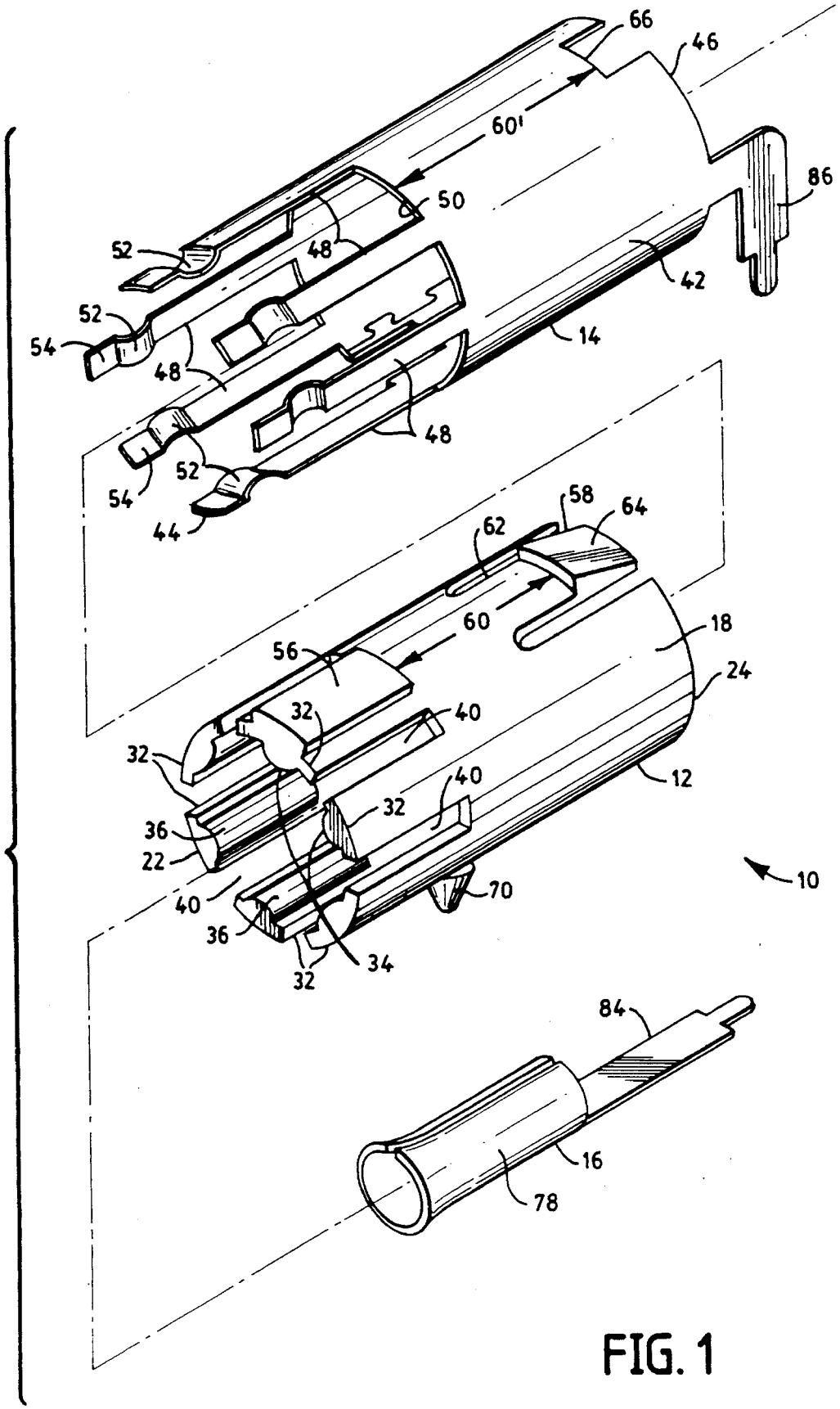
FIG. 1 is an exploded perspective view of the connector of the present invention with the exception of the male connector.
Figure 2:
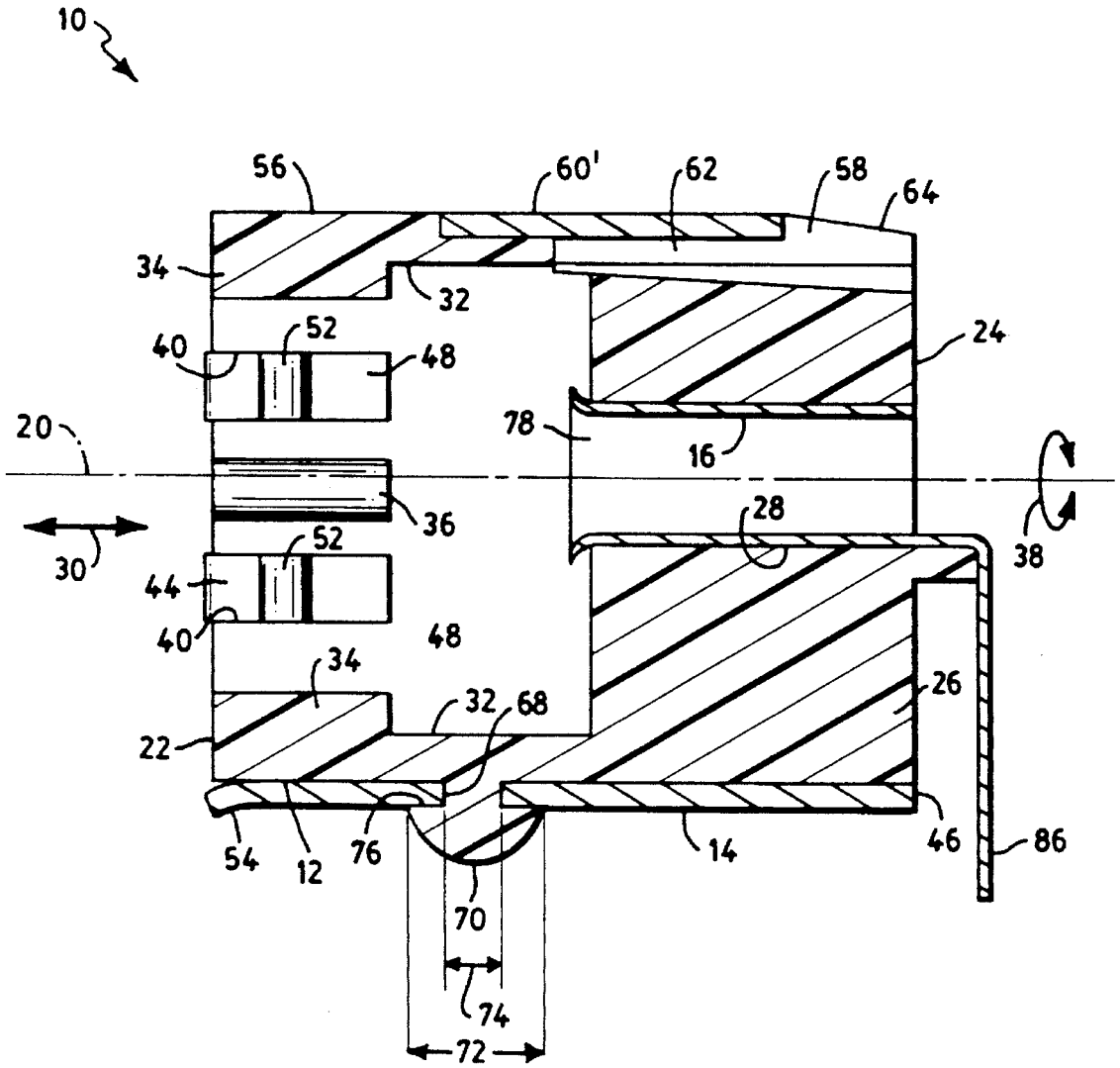
FIG. 2 is a sectional view of the connector of FIG. 1.
Figure 3:
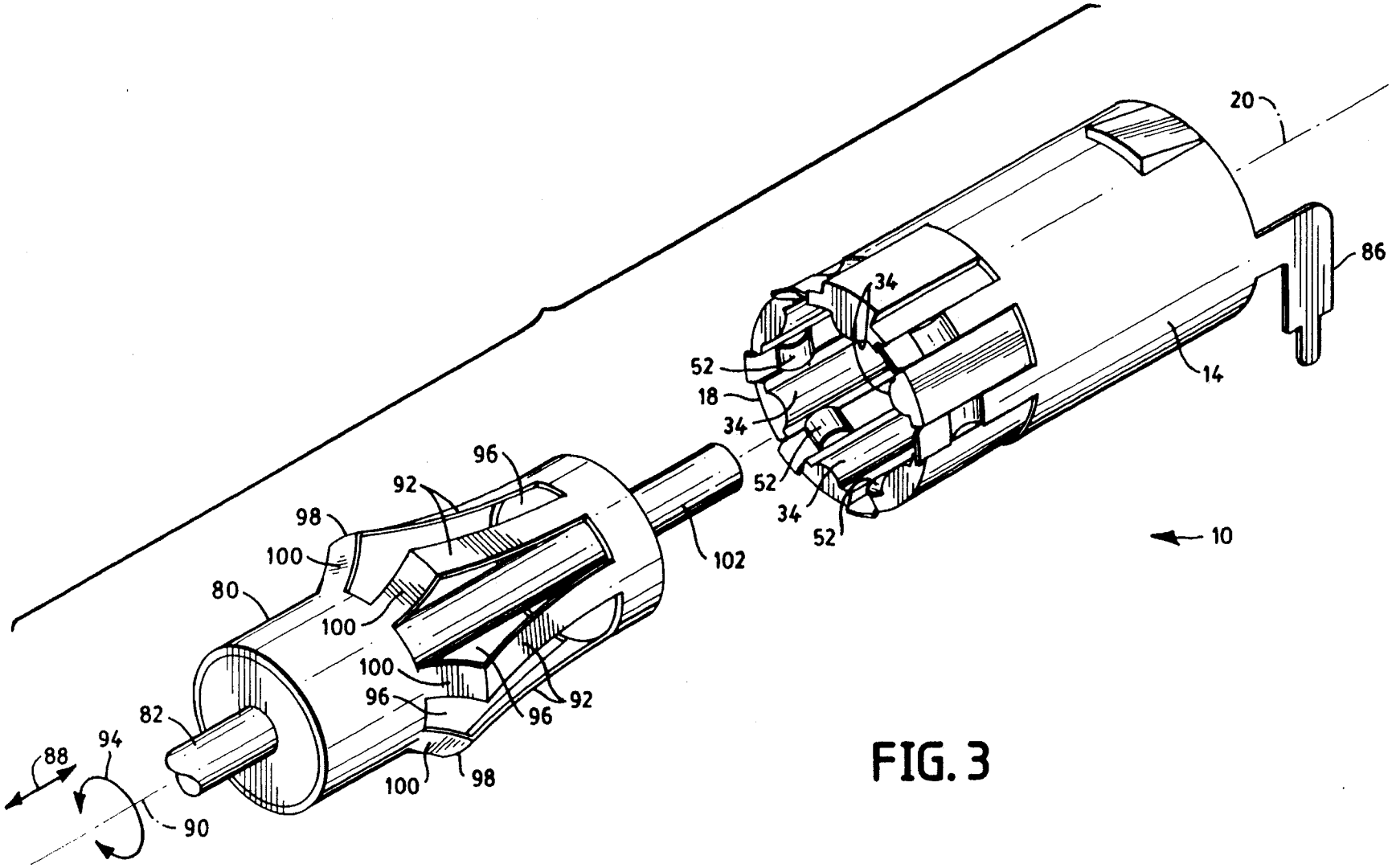
FIG. 3 is an exploded perspective view of the connector of FIG. 1 wherein the insulator 12 and metal shell 14 are shown assembled and further including the male connector.

The embodiment of this invention which is illustrated in FIGS. 1 to 3 is particularly suited for achieving the objects of this invention. FIGS. 1 to 3 depict a connector 10, such as a connector for use with an antenna cable, which comprises an insulator 12, a metal shell 14 and a metal connector 16.

The insulator 12 comprises a thermoplastic insulative material in the form of a cylindrical member 18 having a longitudinal axis 20, a first end 22 and an opposite second end 24. End 24 comprises a base portion 26 having an aperture 28 which extends therethrough in the direction 30 of the longitudinal axis 20. Cylindrical member 18 comprises a plurality of legs 32 which extend in the direction 30 of axis 20 from end 22 towards the base portion 26. At least one leg 32 comprises a protuberance 34 which protrudes towards the axis 20. In the embodiment of FIGS. 1 to 3 each leg 32 comprises a protuberance 34 which in the preferred embodiment comprises an elongated member which extends in the direction 30 of axis 20 and comprises a curved surface 36 which protrudes towards axis 20. Each leg 32 is spaced from an adjacent leg 32 in a circumferential direction 38 relative to axis 20 to provide an elongated opening 40 between adjacent legs 32.

The metal shell 14 comprises a cylindrical member 42 into which the insulator 12 is inserted. Metal shell 14 may comprise preplated brass if desired. Metal shell 14 is concentric with and external of the cylindrical member 18 as depicted in FIGS. 2 and 3. Cylindrical member 42 extends in the direction 30 of axis 20 from end 44 to opposite end 46. End 44 comprises a plurality of legs 48 which extend in the direction 30 of axis 20 from end 44 towards an edge 50 of the cylindrical member 42. Edge 50 is located between ends 44 and 46. At least one leg 48 comprises a protuberance 52 which extends through an opening 40 of the cylindrical member 18 towards axis 20. In the embodiment of FIGS. 1 to 3, each leg 48 comprises a protuberance 52 which extends through a respective opening 40. In the preferred embodiment, each leg 44 includes a leg surface 54 at a distal end which extends away from, and in the direction 30 of axis 20. Such beveled surface 54 facilitates insertion of a male metal connector described herein. In such embodiment, each protuberance 52 is located between a respective leg surface 54 and the edge 50 as depicted in FIG. 1.

In the embodiment of FIGS. 1 to 3, an outer surface of the cylindrical member 18 comprises at least one raised portion 56 adjacent end 22 and at least another raised portion 58 adjacent the opposite end 24. Raised portions 56 and 58 are spaced from each other a distance 60 measured in the direction 30 of axis 20. A segment of the outer surface of the cylindrical member 42 identified by arrow 60' extends between and abuts the raised portions 56 and 58 as depicted in FIGS. 2 and 3. In the preferred embodiment cylindrical member 18 comprises a resilient segment or finger 62 which extends from a distal end of the resilient segment located at end 24 towards end 22. The raised portion 58 protrudes from such distal end of the resilient segment 62. The raised portion 58 includes a surface 64 which is inclined away from axis 20 from end 24 towards end 22. In the embodiment depicted in FIGS. 1 to 3 cylindrical member 42 comprises an edge 66 spaced from end 46 and parallel to edge 50 to form an opening in the surface of metal shell 14 at end 46. When inserting the cylindrical member 18 into the metal shell 14, the surface 64 will engage edge 50 and be cammed towards axis 20 by the inner surface of the metal shell 14 until surface 64 snaps into place at the opening adjacent edge 66. In this manner, segment 60' will extend between raised portions 56 and 58.

Cylindrical member 42 includes a slot 68 which extends through the surface of the cylindrical member 42 as depicted in FIG. 2. Cylindrical member 18 includes a protuberance 70 which protrudes in a radial direction away from axis 20 through slot 68. The diameter 72 of protuberance 70 is greater than the diameter 74 of hole 68 such that the undersurface 76 of the protuberance will bear against the outer surface of a board 77, such as a printed circuit board, to hold connector 10 in place thereon prior to soldering.

The metal connector 16 of the connector 10 is in the form of a metal ferrule which extends through aperture 28 in the direction 30 of axis 20. Ferrule 16 provides a female connector which includes a cylindrical segment 78 into which a male metal connector 80 to which a coaxial cable 82 is connected may be inserted in the conventional manner. Ferrule 16 also comprises a tab 84 which may be electrically and mechanically connected to, for example, a circuit on the printed circuit board 77.

Cylindrical member 42 includes an arm 86 for attaching the connector 10 to, for example, a circuit on the printed circuit board 77.

Connector 10 comprises second metal connector 80 which extends in an axial direction 88 of a longitudinal axis 90 which in use will be coincident with longitudinal direction 20 as depicted in FIG. 3. Metal connector 80 comprises a plurality of beams 92 which extend in the axial direction 88. Each beam 92 is spaced from an adjacent beam 92 in a circumferential direction 94 relative to longitudinal axis 90 to provide respective openings 96 between adjacent beams 92 as depicted in FIG. 3. Each beam 92 includes a portion 98 which protrudes away from axis 90. Each portion 98 comprises an abutment surface 100. In use, in a connecting mode the male metal connector 80 will be inserted into the assembled insulator 12 and metal shell 14 such that the male prong 102 will be coupled to the female metal connector 16 in the conventional manner. When in a connecting mode, each protuberance 52 will lockingly engage a respective abutment surface 100 and each protuberance 34 will extend into a respective opening 96 to thereby impede rotational and axial movement of the male prong 102 relative to the female connector 16.

It will be apparent to those skilled in the art that the female metal connector 16 may be replaced by a male metal connector which will be mounted within aperture 28 of base portion 26. In such an embodiment, the male metal connector 80 will be replaced by a female metal connector to which a coaxial cable 82 will be connected. Connectors 16 and 80 may be pre-plated in a conventional manner, if desired.

Figure 4:
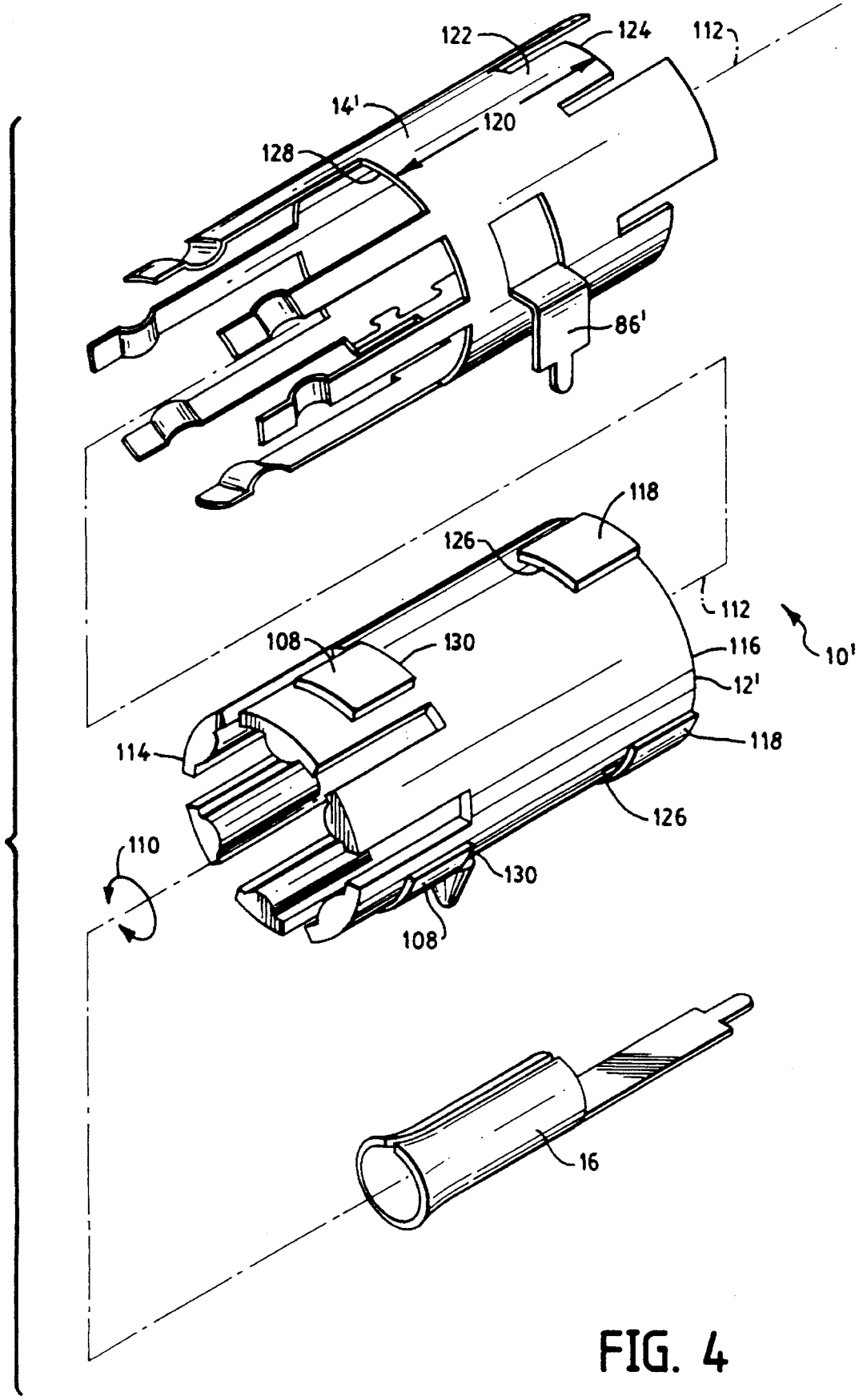
FIG. 4 is an exploded perspective view of an alternative embodiment of the present invention.

An alternative embodiment of the connector of the present invention is depicted in FIG. 4. FIG. 4 depicts a connector 10' identical to connector 10 of FIGS. 1 to 3 except as noted. In particular, connector 10' differs from connector 10 in the manner in which the metal shell 14' is held in place relative to the insulator 12' and the location of arm 86'. The outer surface of the cylindrical member 18' comprises one or more raised portions 108 spaced from each other in a circumferential direction 110 relative to longitudinal axis 112. In the embodiment of Figure there is a plurality of raised portions 108 equally spaced from each other in circumferential direction 110, each raised portion 108 being located between end 114 and opposite end 116 of the cylindrical member 18'. The embodiment of FIG. 4 also includes one or more raised portions 118 spaced from raised portions 108 in the direction of longitudinal axis 112. A segment, identified by arrow 120, of an outer surface of the second cylindrical member 14' extends between at least one of the raised portions 108 and at least one of the raised portions 118. In the preferred embodiment, a plurality of segments 120 extend between respective raised portions 108 and 118 as will be the case in FIG. 4. Each segment may comprise a resilient length 122 having a distal end which includes an edge 124 which engages a respective raised portion 118 at 126. In such embodiment, the cylindrical member 14' will be held in place relative to cylindrical member 12' by the engagement of edges 124 and 128 with raised portions 118 and 108, respectively, at 126 and 130, respectively.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector, comprising:

an insulator comprising a first cylindrical member having a longitudinal axis, a first end and an opposite second end, said opposite second end comprising a base portion having an aperture extending therethrough in the direction of said longitudinal axis, said cylindrical member comprising a plurality of first legs which extend in the direction of said longitudinal axis from said first end towards said base portion, at least one first leg of said plurality of first legs comprising a first protuberance which protrudes towards said longitudinal axis, each first leg of said plurality of first legs being spaced from an adjacent first leg in a circumferential direction relative to said longitudinal axis to provide a respective first opening between adjacent legs;

a metal shell comprising a second cylindrical member concentric with and external of said first cylindrical member and extending in the direction of said longitudinal axis from one end to another end, said one end comprising a plurality of second legs which extend in the direction of said longitudinal axis from said one end towards a first edge of said second cylindrical member located between said one end and said another end, each second leg of said plurality of second legs being spaced from an adjacent second leg in a circumferential direction relative to said longitudinal axis, at least one of said second legs of said plurality of second legs comprising a second protuberance which extends through a first opening towards said longitudinal axis; and a first metal connector which extends through said aperture in the direction of said longitudinal axis.

2. The connector of claim 1 wherein each first leg of said plurality of first legs comprises a first protuberance.

3. The connector of claim 1 wherein each second leg of said plurality of second legs comprises a second protuberance which extends into a respective first opening.

4. The connector of claim 3 wherein each first leg of said plurality of first legs comprises a first protuberance.

5. The connector of claim 4 further including a second metal connector which extends in an axial direction, said second metal connector comprising a plurality of beams which extend in said axial direction, each beam of said plurality of beams being spaced from an adjacent beam in a circumferential direction relative to said axial direction, to provide a respective second opening between adjacent beams, each beam of said plurality of beams having a portion which protrudes away from a longitudinal axis of said second metal connector each portion comprising an abutment surface, said connector extending into said first cylindrical member in a connecting mode such that each second protuberance lockingly engages a respective abutment surface and each first protuberance extends into a respective second opening.

6. The connector of claim 1 wherein each first protuberance comprises an elongated member which extends in the direction of said longitudinal axis and comprises a curved surface which protrudes towards said longitudinal axis.

7. The connector of claim 1 wherein an outer surface of said first cylindrical member comprises a first raised portion and a second raised portion spaced from said first raised portion, and wherein a segment of an outer surface of said second cylindrical member extends between and abuts said first raised portion and said second raised portion.

8. The connector of claim 6 wherein said second raised portion includes a surface which is inclined away from said longitudinal axis in a direction which extends from said opposite second end towards said first end.

9. The connector of claim 8 wherein said second cylindrical member comprises a second edge spaced from said another end and parallel to said first edge, said segment of said second cylindrical member extending from said first edge to said second edge.

10. The connector of claim 9 wherein said first cylindrical member comprises a resilient segment which extends from said second opposite end towards said first end, said second raised portion protruding from said resilient segment.

11. The connector of claim 1 wherein said second cylindrical member includes a slot which extends thereinto, and further wherein said first cylindrical member includes a third protuberance which protrudes in a radial direction away from said longitudinal axis through said slot.

12. The connector of claim 1 wherein said second cylindrical member comprises an arm for attaching said socket to a circuit.

13. The connector of claim 1 wherein an outer surface of said first cylindrical member comprises at least one first raised portion and at least one second raised portion spaced from said at least one first raised portion in the direction of said longitudinal axis, and wherein a segment of an outer surface of said second cylindrical member extends between said at least one first raised portion and said at least one second raised portion.

14. The connector of claim 13 wherein said segment of said outer surface of said second cylindrical member comprises a resilient length, said resilient length comprising a distal end having a second edge which engages said at least one first raised portion.

15. The connector of claim 1 wherein each second leg of said plurality of second legs includes a leg surface which extends away from, and in the direction of, said longitudinal axis.

16. The connector of claim 15 wherein each second protuberance is located between a respective leg surface and said first edge.

* * * * *